US010105566B2

(12) United States Patent
Buikema

(10) Patent No.: US 10,105,566 B2
(45) Date of Patent: Oct. 23, 2018

(54) WEIGHTED SOFT PLATE FITNESS DEVICE

(71) Applicant: Hyper Wear, Inc., Austin, TX (US)

(72) Inventor: Dirk Buikema, Austin, TX (US)

(73) Assignee: Hyper Wear, Inc., Austin, TX (US)

( * ) Notice: Subject to any disclaimer, the term of this patent is extended or adjusted under 35 U.S.C. 154(b) by 151 days.

(21) Appl. No.: 15/397,937

(22) Filed: Jan. 4, 2017

(65) Prior Publication Data

US 2017/0189735 A1 Jul. 6, 2017

Related U.S. Application Data

(60) Provisional application No. 62/275,078, filed on Jan. 5, 2016.

(51) Int. Cl.

| | |
|---|---|
| ***A63B 21/06*** | (2006.01) |
| ***A63B 21/075*** | (2006.01) |
| ***A63B 21/00*** | (2006.01) |
| ***A63B 21/072*** | (2006.01) |

(52) U.S. Cl.

CPC ..... *A63B 21/075* (2013.01); *A63B 21/0603* (2013.01); *A63B 21/0726* (2013.01); *A63B 21/4035* (2015.10)

(58) Field of Classification Search

CPC ..... A63B 21/0724; A63B 21/0722; A63B 21/0728; A63B 21/075; A63B 21/072; A63B 21/0726

See application file for complete search history.

(56) References Cited

U.S. PATENT DOCUMENTS

| | | | |
|---|---|---|---|
| 172,039 | A | 1/1876 | Lazarevitch |
| 177,749 | A | 5/1876 | Redden |
| 1,089,279 | A | 3/1914 | Simer et al. |
| 1,909,921 | A | 5/1933 | Tompkins |
| 2,616,467 | A | 11/1952 | Cicero |
| 2,622,646 | A | 12/1952 | Miller |
| 2,696,342 | A | 12/1954 | Toborg |

(Continued)

FOREIGN PATENT DOCUMENTS

| | | |
|---|---|---|
| CA | 624701 | 8/1961 |

OTHER PUBLICATIONS

International Search Report and Written Opinion from PCT Patent Application No. PCT/US2017/012117, dated Apr. 20, 2017; 14 pages.

(Continued)

*Primary Examiner* — Loan H Thanh
*Assistant Examiner* — Rae Fischer
(74) *Attorney, Agent, or Firm* — Baker Botts L.L.P.

(57) ABSTRACT

A weighted soft plate fitness device is disclosed. The device includes an adjustable dumbbell bar and a weighted soft plate fitness device coupled to the adjustable dumbbell bar. The adjustable dumbbell bar includes a hand grip and an end support coupled to the hand grip. The weighted soft plate fitness device includes a body having a generally circular shape; the body having two edges, wherein the two edges are attached together to form an interior volume; a central opening in the body; and a collapsible inlet which is in open communication with the interior volume and which is movable from a first position in which it extends at least partially outward from the tubular body, to a second position in which it extends at least partially inward into the interior volume.

11 Claims, 6 Drawing Sheets

(56) References Cited

U.S. PATENT DOCUMENTS

| | | | | |
|---|---|---|---|---|
| 2,795,425 | A | 6/1957 | Orms | |
| 3,144,197 | A | 8/1964 | Milner et al. | |
| 3,181,439 | A | 5/1965 | Flax | |
| 3,194,185 | A | 7/1965 | Spinosa | |
| 3,255,927 | A | 6/1966 | Rupert, Jr. et al. | |
| 3,334,899 | A * | 8/1967 | Bosko | A63B 21/0602 446/267 |
| 3,528,652 | A | 9/1970 | Tarbox | |
| 4,062,392 | A | 12/1977 | Ishii | |
| 4,420,275 | A | 12/1983 | Ruser | |
| 4,685,890 | A | 8/1987 | Edwards | |
| 4,707,873 | A | 11/1987 | A-Yan | |
| 4,846,464 | A | 7/1989 | Jorno | |
| 4,952,190 | A | 8/1990 | Tarnoff et al. | |
| 4,997,184 | A | 3/1991 | Sherman | |
| 5,299,999 | A | 4/1994 | Brine | |
| 5,332,185 | A | 7/1994 | Walker, III | |
| 5,429,351 | A | 7/1995 | Hanson | |
| 5,476,067 | A | 12/1995 | Queen et al. | |
| 5,634,576 | A | 6/1997 | Arbel | |
| 5,704,883 | A | 1/1998 | Eckmann | |
| 5,718,655 | A | 2/1998 | Phillips | |
| 5,848,946 | A | 12/1998 | Stillinger | |
| 5,967,952 | A | 10/1999 | Bronstein et al. | |
| 5,984,154 | A | 11/1999 | Scicluna | |
| 6,053,382 | A | 4/2000 | Wyant | |
| 6,099,441 | A | 8/2000 | Bonnet | |
| 6,149,555 | A | 11/2000 | Kinback | |
| 6,149,557 | A | 11/2000 | Williams et al. | |
| 6,186,701 | B1 | 2/2001 | Kempers | |
| 6,216,926 | B1 | 4/2001 | Pratt | |
| 6,224,517 | B1 | 5/2001 | Dereszynski | |
| 6,261,211 | B1 | 7/2001 | Suarez et al. | |
| 6,460,746 | B1 | 10/2002 | Amram | |
| 6,675,391 | B2 | 1/2004 | Morrison | |
| 6,969,195 | B2 | 11/2005 | Ferranda | |
| 7,891,914 | B2 | 2/2011 | Smallwood et al. | |
| 8,231,510 | B2 | 7/2012 | Abdo | |
| 8,550,243 | B2 | 10/2013 | Moore | |
| 2004/0072660 | A1 | 4/2004 | Mercuri et al. | |
| 2005/0096199 | A1 | 5/2005 | Egbert et al. | |
| 2006/0063653 | A1 | 3/2006 | Wickens et al. | |
| 2006/0229173 | A1 | 10/2006 | Foley | |
| 2007/0254785 | A1 | 11/2007 | Lin | |
| 2008/0023513 | A1 | 1/2008 | Hadj-Chikh | |
| 2008/0041906 | A1 | 2/2008 | Rose et al. | |
| 2009/0127299 | A1 | 5/2009 | Jamlang | |
| 2009/0184143 | A1 | 7/2009 | Witt et al. | |
| 2009/0206115 | A1 | 8/2009 | Gleason | |
| 2010/0048363 | A1 | 2/2010 | Gilberti et al. | |
| 2011/0088987 | A1 | 4/2011 | Santy et al. | |
| 2011/0287904 | A1 | 11/2011 | Morris | |
| 2012/0021877 | A1 | 1/2012 | Lundquist et al. | |
| 2013/0292432 | A1 | 11/2013 | Stevens | |
| 2014/0206508 | A1 | 7/2014 | Hall | |
| 2014/0291095 | A1 | 10/2014 | Boldetti et al. | |
| 2014/0326771 | A1 | 11/2014 | Almalki | |

OTHER PUBLICATIONS

Elmer's Deluxe Therapeutic Weights, Bollinger Healthrecare, catalog BHC-001-5/95-20K-SWC, 1995; 8 pages.

Search Report for Corresponding PCT Application No. PCT/US09/52003, dated Sep. 22, 2009; 9 pages.

www.lumb~bros~das.co.uk/acatalog/Lead_Weights_Shot.htmGo_Lead_Shot_Bags, Jul. 26, 2007; 4 pages.

International Preliminary Report on Patentbility for PCT Patent Application No. PCT/US2017/012117, dated Jul. 19, 2018; 10 pages.

* cited by examiner

WEIGHTED SOFT PLATE FITNESS DEVICE

CROSS REFERENCE TO RELATED APPLICATION

This application claims the benefit of priority from U.S. Provisional Application No. 62/275,078 filed on Jan. 5, 2016, the contents of which is incorporated herein by reference in its entirety.

TECHNICAL FIELD

The present disclosure relates to the field of weight training and physical conditioning. More specifically, the present disclosure relates to weighted soft plate fitness devices.

BACKGROUND

A common dumbbell can be purchased in various dimensions of weight that is either fixed or adjustable. Fixed dumbbells are constructed from various solid metal materials to have a specified weight. Adjustable dumbbells are constructed from a short metal bar to which the user can attach various sized solid plate weights. The amount of weight is varied by either selecting a different weight fixed dumbbell or removing and/or adding weight plates to an adjustable dumbbell. For physical exercise, dumbbells are typically grasped by the bar and moved in a large variety of ways to build muscular strength.

SUMMARY

In accordance with embodiments of the present disclosure, a weighted soft plate fitness device is disclosed. The device includes an adjustable dumbbell bar and a weighted soft plate fitness device coupled to the adjustable dumbbell bar. The adjustable dumbbell bar includes a hand grip and an end support coupled to the hand grip. The weighted soft plate fitness device includes a body having a generally circular shape; the body having two edges, wherein the two edges are attached together to form an interior volume; a central opening in the body; and a collapsible inlet which is in open communication with the interior volume and which is movable from a first position in which it extends at least partially outward from the tubular body, to a second position in which it extends at least partially inward into the interior volume.

In accordance with embodiments of the present disclosure, a weighted adjustable fitness device is disclosed. The device includes a body having a generally circular shape; the body having two edges, wherein the two edges are attached together to form an interior volume; a central opening in the body; and a collapsible inlet which is in open communication with the interior volume and which is movable from a first position in which it extends at least partially outward from the tubular body, to a second position in which it extends at least partially inward into the interior volume.

In accordance with embodiments of the present disclosure, a weighted soft plate fitness device is disclosed. The device includes an adjustable dumbbell bar and a plurality of weighted soft plate fitness devices coupled to the adjustable dumbbell bar. The adjustable dumbbell bar includes a hand grip and an end support coupled to the hand grip. Each of the weighted soft plate fitness devices includes a body having a generally circular shape; the body having two edges, wherein the two edges are attached together to form an interior volume; a central opening in the body; and a collapsible inlet which is in open communication with the interior volume and which is movable from a first position in which it extends at least partially outward from the tubular body, to a second position in which it extends at least partially inward into the interior volume, wherein at least one dimension of the body of at least one of the plurality of weighted soft plate fitness devices is different from at least one dimension of the body of at least one other of the plurality of weighted soft plate fitness devices.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

For physical exercise, a dumbbell or barbell may be used for free weight training. Plate weights may be added on a metal bar to change the weight of the dumbbell or barbell. Additionally, plate weights may be used individually for weight training when the person exercising grasps the plate weight and performs a range of exercise movements. Given the benefits of physical exercise with common dumbbells, barbells, and plate weights, there is a need for a more useful functional soft plate weight that may be adjustable in weight, have a particulate fill material that may be dynamically adjusted and/or shifted (e.g., during exercise or on-the-fly at the user's discretion), and that may be safer and quieter than common weights. Such soft plate weights may be designed to be used with or without a bar allowing for variation and adjustment in weight and resistance characteristics of the barbell, dumbbell, and/or soft plate weight. The dynamic and modular nature of such a fitness device is described herein.

The present disclosure is related generally to a weighted soft plate fitness device. The weighted soft plate device may include a generally circular body similar to a plate with an opening in the center. The device may include an inlet to allow the device to be filled with particulate material to adjust the weight or resistance characteristics of the device. The device may also include a reinforcement spool reinforcing the central opening to provide additional support for the device when placed on a rod, such as a dumbbell or barbell. The device may also be fixed to a rod, such as a dumbbell or barbell. The device may be used to perform exercises and weight training.

Figure 1:
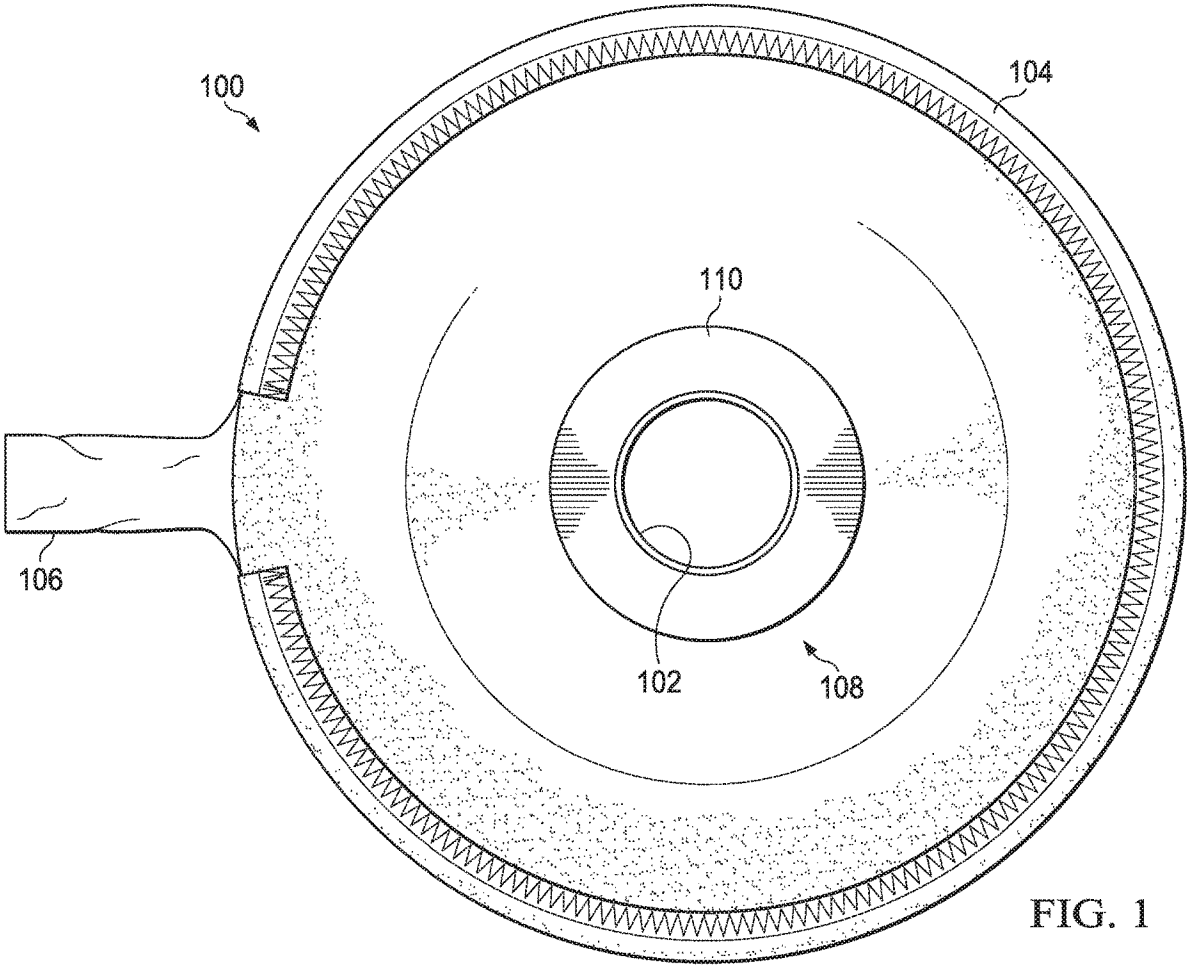
FIG. 1 illustrates a top view of a weighted soft plate fitness device, in accordance with some embodiments of the present disclosure.

FIG. 1 illustrates a top view of a weighted soft plate fitness device, in accordance with some embodiments of the present disclosure. Weighted soft plate fitness device 100 may have a generally circular shape with generally circular opening 102 in the approximate center of device 100. Device 100 may include a circular body 104, collapsible inlet 106, interior volume 108, and reinforcement spool 110.

Circular body 104 may be a generally circular body with central opening 102 resembling a plate weight. Circular body 104 may be made of a deformable material that may be more easily gripped for use in various exercises. Circular body 104 may be constructed of various types of fabrics (for example neoprene, nylon, canvas, or rubber) and various types of metals and fibers. Circular body 104 may also be constructed from a resilient or elastomeric material, such as a neoprene/nylon laminate consisting of a thick layer of neoprene with a thinner layer of nylon laminated to each side. The use of such materials may allow device 100 to be more easily gripped, which is an aspect of some physical fitness applications. In some embodiments, various materials may be incorporated into circular body 104 to impart anti-soiling, anti-bacterial, anti-staining or decorative properties, or to render device 100 moisture-proof, water-proof, moisture-resistant, or water-resistant.

Circular body 104 may be constructed from two or more generally circular sheets of material, where each sheet of material has a central opening, by coupling edges of the sheets of material together forming one or more seams (e.g., by stitching near a periphery of the opposing edges). In some embodiments, the opposing edges of circular body 102 may be double-stitched, glued, fused under heat or pressure, or laminated together along a seam. In some embodiments, the stitching may follow a generally nonlinear pattern. The seam may be constructed such that it faces inward or outward from device 100. The stitching pattern may be selected to improve impact resistance, minimize tearing, and prevent particulate material from leaking from interior volume 108. An example stitching method is described in further detail in FIG. 5.

When its opposing edges are attached together, circular body 104 may form interior volume 108. Device 100 may be constructed such that interior volume 108 may be filled with particulate material. The volume and mass of the aggregate particulate material may be reversibly adjusted by adding or subtracting particulate material. Device 100 may be filled using a funnel to assist in directing particulate material through collapsible inlet 106 into interior volume 108.

Collapsible inlet 106 may enable adjustment of the volume and weight of fill material. Interior volume 108 may be filled with particulate material while the inlet is in the first position as shown in FIG. 1. Once filled to the desired weight, collapsible inlet 106 may be moved to the second position, as described in more detail with respect to FIG. 2. Collapsible inlet 106 may be made of various materials including, for example, nylon, rubber, various fabrics, or other suitable materials which are sufficiently deformable such that the pressure exerted by the particulate material may effectively seal collapsible inlet 106 when interior volume 108 is at least partially filled. Collapsible inlet 106 may be in open communication with interior volume 108 and may be movable from a first position in which it extends from circular body 104, as shown in FIG. 1, to a second position in which it extends into interior volume 108, as described in FIG. 2. Collapsible inlet 106 may be further held closed when in the second position by velcro, snaps, zippers, buckles, or other suitable closure.

Collapsible inlet 106 may comprise one or more sheets of identically or complementary shaped portions of material comprising lateral edges joined together to form one or more seams and be configured such that when the inlet is in the first position, the one or more seams are inverted. The portions of collapsible inlet 106 may be stitched, double-stitched, glued, or laminated together along a first and a second opposing edges. The seam formed in this manner may be facing outward such that, when collapsible inlet 106 is in the second position, the opposing surfaces of collapsible inlet 106 will tend to lie flush together, thus preventing the egress of particulate material through collapsible inlet 106. Collapsible inlet 106 may additionally be held closed through the use of velcro, snaps, zippers, buckles, or may be permanently sealed. In some embodiments, collapsible inlet 106 may not extend outward from device 100. When collapsible inlet 106 is inverted (as when it is in the first position in which it extends from circular body 104 of device 100, as shown in FIG. 1), the inverted seam may cause collapsible inlet 106 to pucker open slightly, thus facilitating the addition of particulate material to device 100. Unitary constructions may also be employed for collapsible inlet 106.

The proximal portion of each opposing wall of collapsible inlet 106 may be sewn to the adjacent portion of circular body 104 via a double-stitching technique. A double stitching technique may be a continuation of the stitching used to sew the opposing sides of circular body 104 together. Such a construction may minimize the stress applied to collapsible inlet 106 along the region of attachment. In some embodiments, collapsible inlet 106 may be double-stitched, glued, or laminated to the adjacent portion of circular body 104. In some embodiments, the stitching may follow a generally nonlinear pattern. The seam may be constructed such that it faces inward or outward from device 100. The stitching pattern may be selected to improve impact resistance, minimize tearing, and prevent particulate material from leaking from interior volume 108.

The proximal portion of collapsible inlet 106 may be rounded to match the curvature of the seam, though in some embodiments, the proximal portion of collapsible inlet 106 may be flat instead. The preferred geometry of collapsible inlet 106 may be determined in part by the geometry of circular body 104. The proximal portion of collapsible inlet 106 may be tapered or flared to increase the surface area available for stitching, thus improving the integrity of the seam between collapsible inlet 106 and circular body 104. However, a narrower neck of such an inlet may hinder the escape of particulate material from interior volume 108. In some embodiments, the distal portion of collapsible inlet 106 may also be tapered or flared. Such an embodiment may be advantageous in some applications in that it may facilitate the insertion of a tube or funnel into collapsible inlet 106 when it is in the first position to aid in filling interior volume 108 with particulate material.

In some embodiments, the proximal portion of collapsible inlet 106 may be provided with an extra portion of material which may be folded over prior to stitching the proximal portion of collapsible inlet 106 to the adjacent portion of circular body 104. In some applications, such an approach may improve the durability of the portion of the seam extending across collapsible inlet 106. In some embodiments, this portion of collapsible inlet 106 may be folded over the adjacent portion of the exterior of circular body 104 prior to being sewn or otherwise attached in place.

Collapsible inlet 106 may vary in size and the size may depend, in part, on the overall size of device 100 and the intended use of device 100. Collapsible inlet 106 may have sufficient dimensions such that the collapse of the inlet into the second position will effectively seal the particulate material within interior volume 108, as described in more detail in FIG. 2.

Device 100 may also include reinforcement spool 110. Reinforcement spool 110 may be coupled to the perimeter of central opening 102 and may serve to reinforce the seam at central opening 102 during the use of device 100. Reinforcement spool 110 may be constructed of any material having sufficient strength to allow a user of device 100 to perform exercise activities without the integrity of device 100 being compromised, such as nylon webbing, plastic, rubber, composite, metal, or any other suitable type of reinforcement material. In some embodiments, reinforcement spool 110 may be a ring or grommet. Reinforcement spool 110 may allow device 100 to be slid onto a bar and reduce the friction and stresses on circular body 104 during use as well as provide additional support for device 100.

Reinforcement spool 110 may have any suitable diameter based on the parameters of use. For example, reinforcement spool 110 may have an internal diameter corresponding to the diameter of a barbell or dumbbell with which the soft plate fitness device will be used. For example, barbells and dumbbells often have standard sizes such as 1-inch and 2-inches. Reinforcement spool 110 may have an internal diameter of approximately 0.9-inch or approximately 1.5-inches. However, in some applications the internal diameter of reinforcement spool 110 may be larger or smaller.

Reinforcement spool 110 may be removable from device 100 and allow for various sizes of reinforcement spools 110 to be used to accommodate different sized barbells and dumbbells. For example the diameter of central opening 102 may be larger than the diameter of an available dumbbell. A reinforcement spool 110 having an outer diameter corresponding to the diameter of central opening 102 and an inner diameter corresponding to the diameter of the available dumbbell may be used to allow device 100 to be used with any size dumbbell.

Device 100 may be constructed in various diameters to change the dimensions of interior volume 108. Changing the dimensions of interior volume 108 may change the volume of particulate material that may be used to fill interior volume 108 and therefore may change the weight and resistance characteristics of device 100. In some embodiments, the type of particulate material used to fill interior volume 108 may vary. For example, the particulate material may vary depending, in part, on the intended use of device 100. The particulate material may include sand, metals (including, but not limited to, iron and lead), metal shot, metal shavings, water, pebbles, beans, seeds, gravel, wood pellets, and various other liquids and granular materials (or combinations thereof). In some embodiments, expandable foams may also be utilized. In certain embodiments, various gases may be used as fill materials. In other embodiments, various viscous or gelatinous materials may be used as fill materials including, but not limited to, silica gel.

Because device 100 may be constructed in various sizes and weights, device 100 may be used in many of the same exercises that conventional dumbbells, barbells and other such devices are commonly utilized in, in addition to a variety of exercises for which the foregoing devices are not suitable. In such applications, the deformability of device 100 offers unique advantages. For example, because device 100 can be made to conform to the user's hands, device 100 provides a firm grip to the user while also fully engaging the muscles of the hands and fingers of the user during a workout. The degree of conformity may be adjusted within a certain range by adjusting the extent to which device 100 is filled and/or through selection of appropriate particulate material used to fill device 100. Typically, reducing the amount of fill will increase the conformity of the device within a certain range.

In addition, because the exterior surface of device 100 may comprise neoprene or other soft, elastomeric materials, incidental contact with these surfaces during a workout are unlikely to harm the user. This feature makes device 100 especially suitable for use by children and the elderly. Moreover, this feature, in combination with the durable structures device 100 may be fabricated in, enables a variety of exercises in which device 100 may be thrown or caught. Such a use is typically not feasible with conventional weights or dumbbells.

Figure 2:
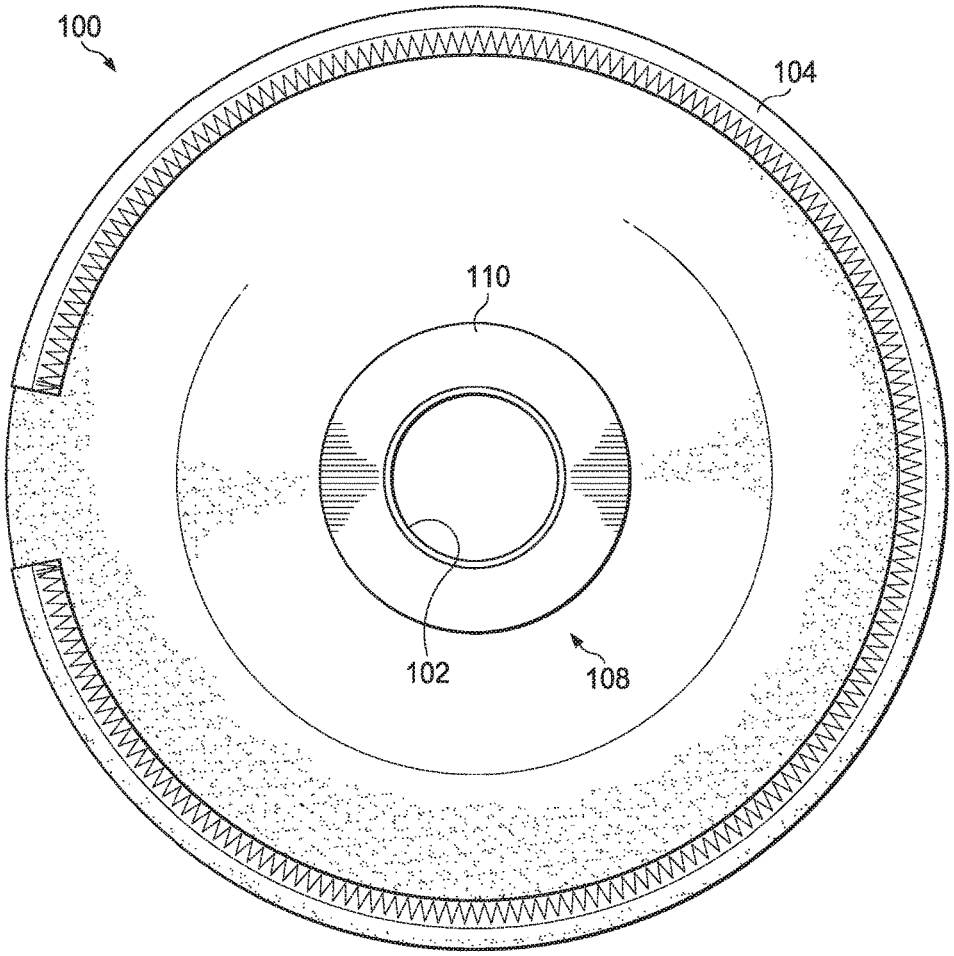
FIG. 2 illustrates a top view of a weighted soft plate fitness device when a collapsible inlet is inserted into an interior volume of the body of the device, in accordance with some embodiments of the present disclosure.

FIG. 2 illustrates a top view of a weighted soft plate fitness device when the collapsible inlet is inserted into the interior volume of the body of the device, in accordance with some embodiments of the present disclosure. In FIG. 2, collapsible inlet 106 is shown in the second position. Collapsible inlet 106 may be moved to the second position for example, through the use of a rod, a tube, the end of the funnel used to fill the device, or a finger. When the inlet is in the second position, the weight and pressure of the particulate material collapses the inlet and effectively seals it off, thereby securely sealing the particulate material within the weighted article without the need for knots, twine, or other such accoutrements. Collapsible inlet 106 may be fully extended within circular body 104 when it is in the second position, although in some embodiments collapsible inlet 106 may be only partially extended within circular body 104 or may be folded or otherwise placed in a different orientation when it is in the second position.

If it is desired to remove some or all of the particulate material from circular body 104, a funnel or a rigid tube of a suitable diameter may be used to maintain collapsible inlet 106 in an open position while removing the particulate material. Removal of particulate material may be preferably performed when collapsible inlet 106 is in the first position, as shown in FIG. 1.

In some embodiments, it may be desirable for collapsible inlet 106 to be permanently sealed after filling interior volume 108 with particulate material. This may be accomplished, for example, by fusing the inlet under heat or pressure, by sewing, by gluing the inlet closed, or by other suitable method of permanently sealing. In some embodiments, device 100 may not include collapsible inlet 106 and may be filled via an opening in an edge of device 100. The opening may then be permanently closed.

Figure 3:
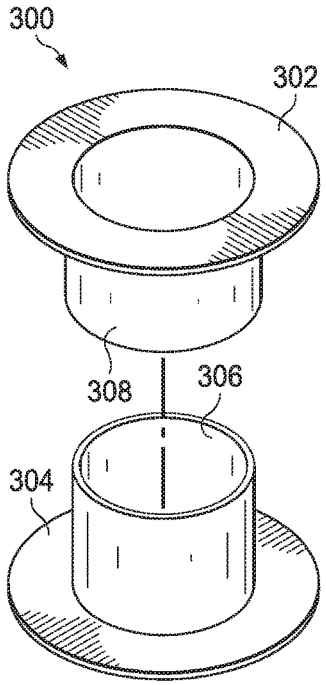
FIG. 3 illustrates an exploded view of one embodiment of a reinforcement spool, in accordance with some embodiments of the present disclosure.

FIG. 3 illustrates an exploded view of one embodiment of a reinforcement spool, in accordance with some embodiments of the present disclosure. Reinforcement spool 300 may include two sections 302 and 304. When placed into the central opening of a weighted soft plate fitness device, such as central opening 102 of device 100 shown in FIG. 1, section 302 may be placed on one side of the device and section 304 may be placed on the other side of the device and shafts 306 and 308 of sections 302 and 304 may be held together. Sections 302 and 304 may be coupled via any suitable coupling method including threading, an interference fit, friction, or using an adhesive. Sections 302 and 304 may be formed of any suitable material including plastic, rubber, composite, or metal and may be rigid or deformable.

Sections 302 and 304 may have any suitable diameters based on the parameters of use. For example, sections 302 and 304 may have an internal diameters corresponding to the diameter of a barbell or dumbbell with which the soft plate fitness device will be used. For example, barbells and dumbbells often have standard sizes such as 0.9-inch and 1.5-inches. Sections 302 and 304 may have an internal diameters of approximately 0.9-inch or approximately 1.5-inches. However, in some applications the internal diameters of sections 302 and 304 may be larger or smaller.

Figure 4:
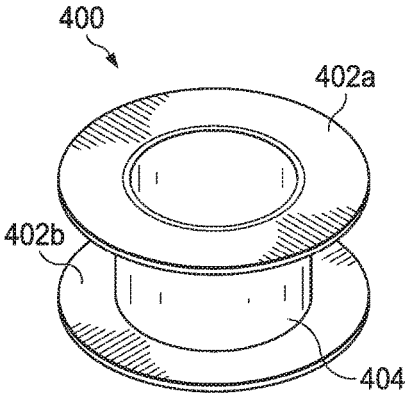
FIG. 4 illustrates a perspective view of one embodiment of a reinforcement spool, in accordance with some embodiments of the present disclosure.

FIG. 4 illustrates a perspective view of one embodiment of a reinforcement spool, in accordance with some embodiments of the present disclosure. Reinforcement spool 400 may be a monolithic component formed of a flexible material such as rubber or flexible plastic. To place reinforcement spool 400 into the central opening of a weight soft plate fitness device, such as central opening 102 of device 100 shown in FIG. 1, one or more edge 402*a* and/or 402*b* may be deformed such that edge 402 fits through the central opening.

Reinforcement spool 400 may have any suitable diameter based on the parameters of use. For example, reinforcement spool 400 may have an internal diameter corresponding to the diameter of a barbell or dumbbell with which the soft plate fitness device will be used. For example, barbells and dumbbells often have standard sizes such as 0.9-inch and 1.5-inches. Reinforcement spool 400 may have an internal diameter of approximately 0.9-inch or approximately 1.5-inches. However, in some applications the internal diameter of reinforcement spool 400 may be larger or smaller.

Figure 5:
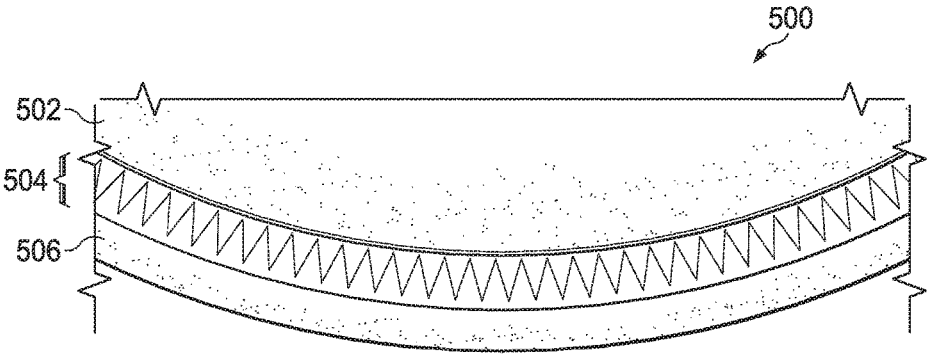
FIG. 5 illustrates a perspective view of one embodiment of a section of a seam on a weighted soft plate fitness device, in accordance with some embodiments of the present disclosure.

FIG. 5 illustrates a perspective view of one embodiment of a section of a seam on a weighted soft plate fitness device, in accordance with some embodiments of the present disclosure. Device 500 includes two or more opposing walls of material 502 coupled together at seam 504 to form an interior volume to which particular material may be added. The opposing walls of material 502 may be double stitched together along seam 504 to improve impact resistance and minimize tearing of device 500.

Device 100 may feature functional color coding. The color coding may indicate the size, weight, weight capacity, or other aspect of device 100. For example, color coding may indicate the diameter of device 100, the effective volume of device 100 (for example, calculated based on the diameter of circular body 104), weight, or the weight capacity of device 100 (determined as the maximum weight of a filled device 100). In some embodiments, device 100 may include capping material 506 that may be color coded. In some embodiments, all or portions of circular body 104 may be color coded. By way of example and not limitation, a device 100 weighing fifteen pounds may have a blue capping material 506 and a device 100 weighing thirty pounds may have an orange capping material 506. As another example, a device 100 of diameter three inches may be have a purple capping material 506 and a device 100 of diameter five inches may have a yellow capping material 506. Multiple devices 100 may be sold as a set where the devices 100 included in the set have the same or different diameters, effective volumes, or weight capacity.

Figure 6:
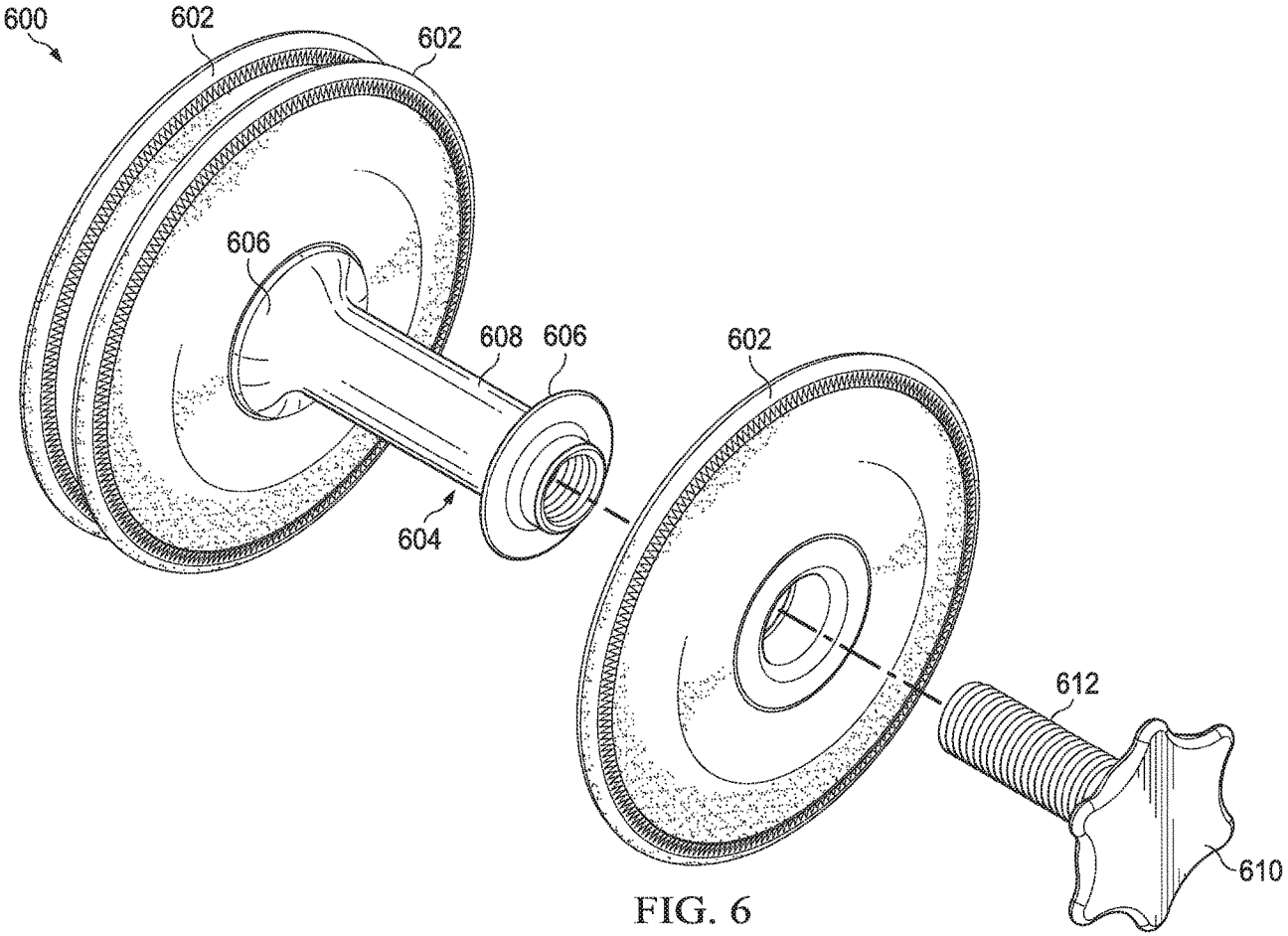
FIG. 6 illustrates an exploded view of weighted soft plate fitness devices on an adjustable dumbbell bar, in accordance with some embodiments of the present disclosure.
Figure 7:
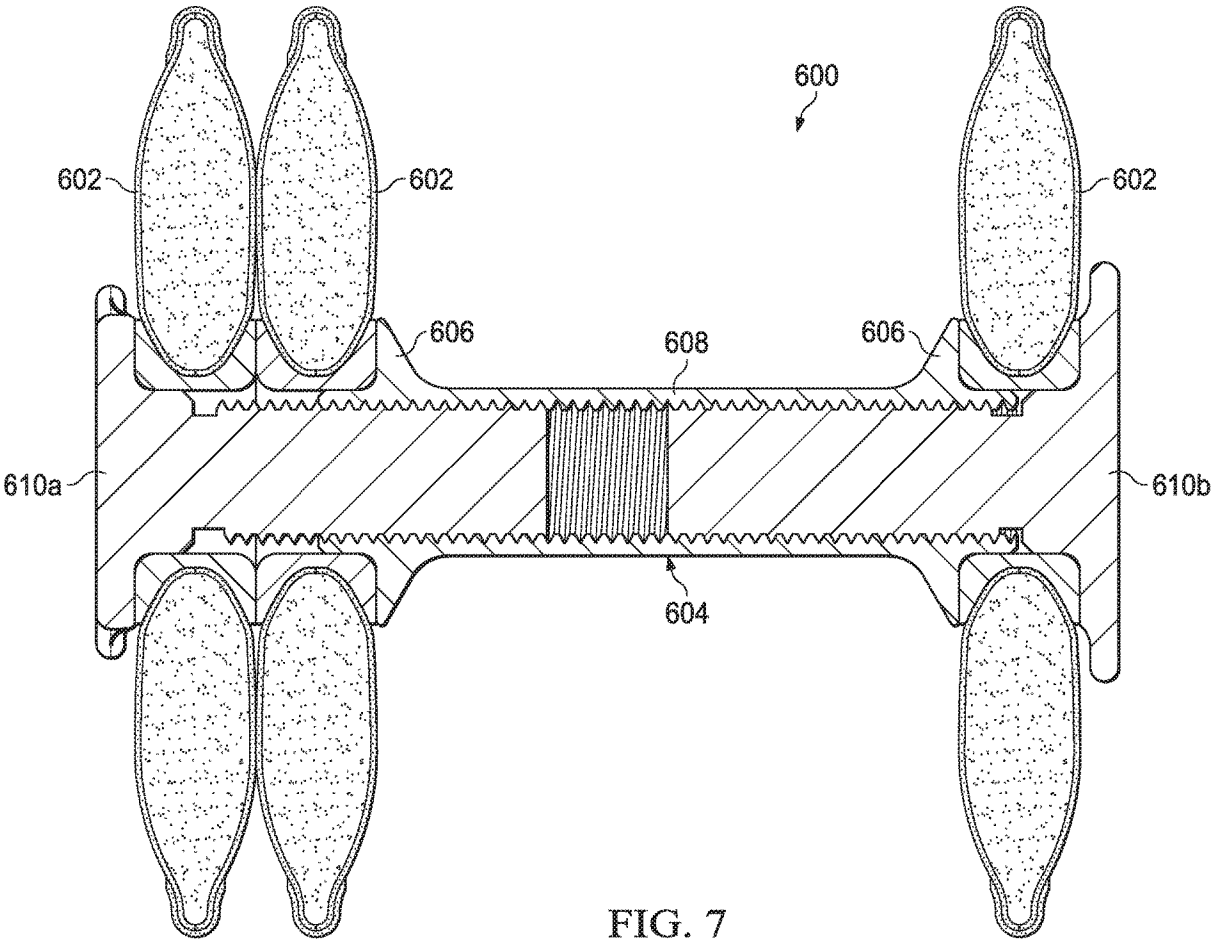
FIG. 7 illustrates a cross sectional view of weighted soft plate fitness devices on an adjustable dumbbell bar, in accordance with some embodiments of the present disclosure.

FIG. 6 illustrates an exploded view of weighted soft plate fitness devices on an adjustable dumbbell bar, in accordance with some embodiments of the present disclosure. FIG. 7 illustrates a cross sectional view of a weighted soft plate fitness devices on an adjustable dumbbell bar, in accordance with some embodiments of the present disclosure. Dumbbell 600 may include one or more weighted soft plate fitness devices 602 placed on adjustable dumbbell bar 604. When multiple devices 602 are placed adjacent to one another on one side of bar 604, devices 602 may provide support for devices 602 placed next to it. Adjustable dumbbell bar 604 may include protrusions 606 on opposite ends of hand grip 608. Protrusions 606 may provide additional support and may prevent devices 602 from sliding down bar 604 onto hand grip 608. Additionally, bar 604 may be hollow and may include internal threads such that end support 610 may couple to bar 604. End support 610 may hold one or more devices 602 on bar 604. End support 610 may couple to bar 604 via any suitable coupling mechanism including threads 612 or an interference fit. In some embodiments, devices 602 may be held onto bar 604 by a standard clip collar. End support 610 may be inserted into bar 604 by different amounts depending on the number of devices 602 placed on bar 604. For example, as shown in FIG. 7, end support 610*a* is inserted into bar 604 less than end support 610*b* is inserted into bar 604.

Bar 604 and end support 610 may be made of any suitable material having sufficient strength to support the weight and bending moment created by devices 602 during use. For example bar 604 and end support 610 may be formed of metal, wood, plastic, or composite. Bar 604 and end support 610 may have any suitable size. For example, bar 604 and end support 610 may have a diameter corresponding to standard barbell and dumbbell sizes such as approximately 0.9-inch and approximately 1.5-inches, although bar 604 and end support 610 may be larger or smaller depending on the intended application.

Figure 8:
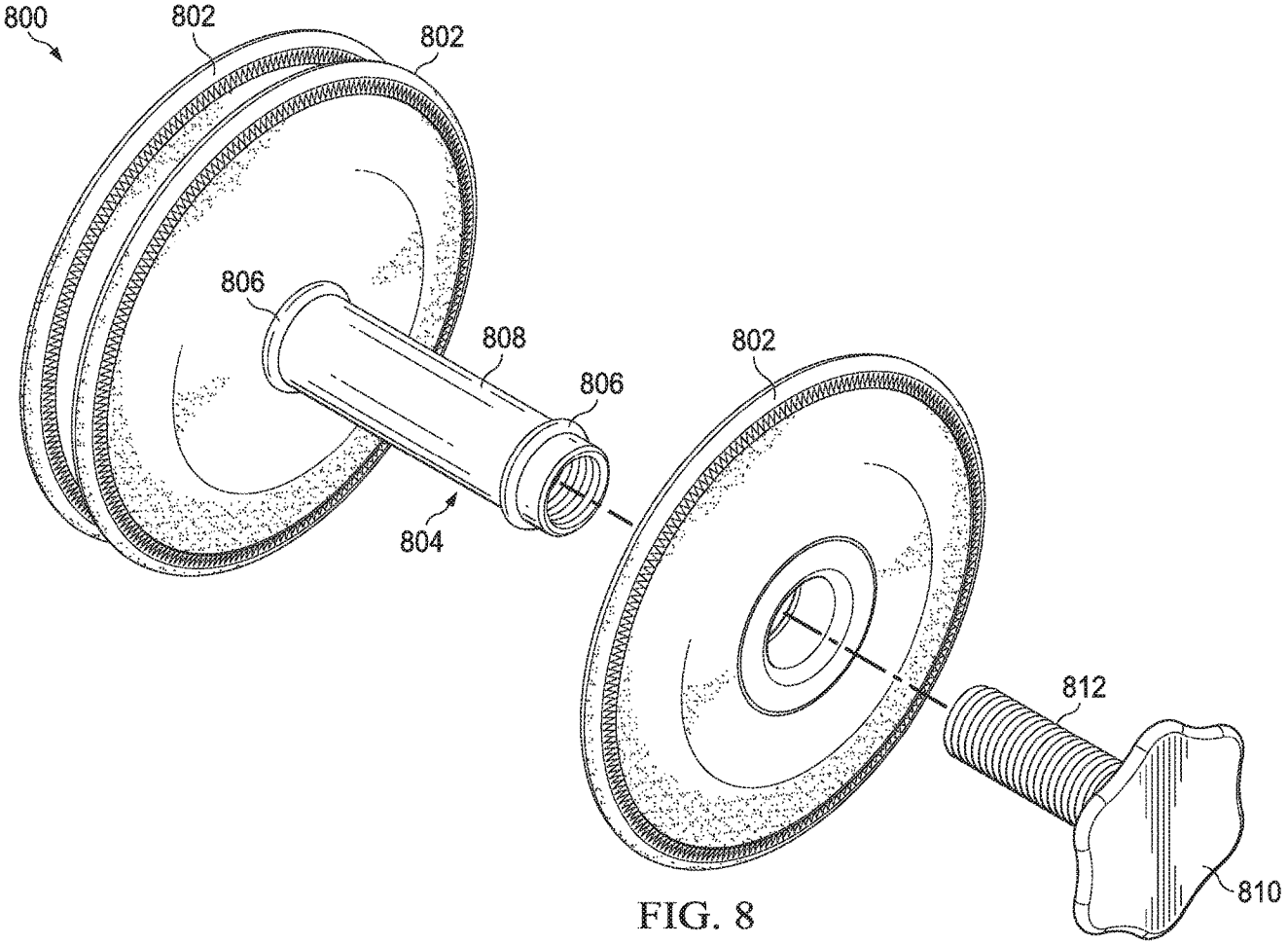
FIG. 8 illustrates an exploded view of weighted soft plate fitness devices on an adjustable dumbbell bar, in accordance with some embodiments of the present disclosure.

FIG. 8 illustrates an exploded view of weighted soft plate fitness devices on an adjustable dumbbell bar, in accordance with some embodiments of the present disclosure. Dumbbell 800 may include one or more weighted soft plate fitness devices 802 placed on adjustable dumbbell bar 804. Weighted soft plate fitness devices 802 may be similar to weighted soft plate fitness devices 602 shown in FIGS. 6 and 7. Adjustable dumbbell bar 804 may include protrusions 806 on opposite ends of hand grip 808. Protrusions 806 may function similarly to protrusions 606 shown in FIGS. 6 and 7, but may have a lower profile. For example, protrusions 806 may extend approximately 0.125-inches from the outer diameter of bar 804. Bar 804 may be similar to bar 604 shown in FIGS. 6 and 7. End support 810 may hold one or more devices 802 on bar 804 and may be similar to end support 610 shown in FIGS. 6 and 7.

The above description of the present disclosure is merely exemplary in nature and is not intended to limit the scope of the application and uses of the described embodiments. It should be apparent to a person of ordinary skill in the field, that the disclosed embodiments are exemplary and not exhaustive of all possible embodiments. For example, while the weighted soft plate fitness device was described as generally circular, the device may be essentially polyhedral (including, without limitation, tetrahedral, pentahedral or hexahedral), prismatic, torroidal, spherical, or irregular in shape. It will thus be appreciated that various additions, substitutions and modifications may be made to the above described embodiments without departing from the scope of the present disclosure.

What is claimed is:

1. A weighted adjustable fitness device comprising:
an adjustable dumbbell bar, the adjustable dumbbell bar including:
a hand grip;
an end support coupled to the hand grip; and
a weighted soft plate fitness device coupled to the adjustable dumbbell bar, the weighted soft plate fitness device including:
a body having a generally circular shape and two edges, wherein the two edges are attached together to form an interior volume;
a central opening in the body;
a reinforcement spool coupled to the central opening; and
a collapsible inlet which is in open communication with the interior volume and which is movable from a first position in which it extends at least partially outward from the body, to a second position in which it extends at least partially inward into the interior volume.

2. The weighted adjustable fitness device of claim 1, wherein the adjustable dumbbell bar further includes a protrusion between the hand grip and the weighted soft plate fitness device.

3. The weighted adjustable fitness device of claim 1, wherein the end support is coupled to the hand grip by threads.

4. The weighted adjustable fitness device of claim 1, wherein the interior volume is filled with a particulate material.

5. The weighted adjustable fitness device of claim 1, wherein the reinforcement spool is formed of a plastic, a rubber, a composite, or a metal.

6. The weighted adjustable fitness device of claim 1, wherein the reinforcement spool has an internal diameter of between approximately 0.9 inches and 1.5 inches.

7. The weighted adjustable fitness device of claim 1, wherein the reinforcement spool is formed of two sections held together by threads, interference fit, friction, or adhesive.

8. The weighted adjustable fitness device of claim 1, wherein the two edges of the body are attached by sewing, fusing under heat or pressure, or gluing.

9. A weighted adjustable fitness device comprising:
an adjustable dumbbell bar, the adjustable dumbbell bar including:
a hand grip;
an end support coupled to the hand grip; and
a plurality of weighted soft plate fitness devices coupled to the adjustable dumbbell bar, each of the weighted soft plate fitness devices including:
a body having a generally circular shape and two edges,
wherein the two edges are attached together to form an interior volume;
a central opening in the body;
a reinforcement spool coupled to the central opening; and
a collapsible inlet which is in open communication with the interior volume and which is movable from a first position in which it extends at least partially outward from the body, to a second position in which it extends at least partially inward into the interior volume,
wherein a dimension of the body of one of the plurality of weighted soft plate fitness devices is different from a dimension of the body of another of the plurality of weighted soft plate fitness devices.

10. The weighted adjustable fitness device of claim 9, wherein the adjustable dumbbell bar further includes a protrusion between the hand grip and the weighted soft plate fitness device.

11. The weighted adjustable fitness device of claim 1, wherein the reinforcement spool is formed of a plastic, a rubber, a composite, or a metal.

* * * * *